United States Patent [19]

Short

[11] Patent Number: 4,655,536

[45] Date of Patent: Apr. 7, 1987

[54] PLUG ARRANGEMENT FOR ELECTRIC CORD SET

[75] Inventor: Stephen P. Short, Johnston, R.I.

[73] Assignee: General Electric Company, Schenectady, N.Y.

[21] Appl. No.: 786,574

[22] Filed: Oct. 11, 1985

[51] Int. Cl.[4] ..... H01R 13/502

[52] U.S. Cl. ..... 339/191 R; 339/196 R; 339/217 PS

[58] Field of Search ..... 339/191 R, 191 A, 191 S, 339/191 M, 206 R, 206 P, 207 R, 217 R, 217 PS, 218 R, 218 M, 218 C, 206 L, 196 R, 196 A, 196 M, 209, 211, 184 R, 192 R, 278 D

[56] References Cited

U.S. PATENT DOCUMENTS

| | | | |
|---|---|---|---|
| 1,410,651 | 5/1922 | Caps | 339/191 R |
| 1,894,112 | 1/1933 | McNeil | 339/191 R |
| 2,032,470 | 3/1936 | Chirelstein | 339/196 R |
| 2,531,625 | 11/1950 | Hubbell | 200/51.09 |
| 2,545,536 | 3/1951 | Von Holtz | 173/330 |
| 2,770,786 | 11/1956 | Czyzewski | 339/40 |
| 2,834,951 | 5/1958 | Aquillon et al. | 339/217 S |
| 2,932,000 | 4/1960 | Buchanan | 339/191 R |
| 4,500,160 | 2/1985 | Bertsch | 339/196 R |

FOREIGN PATENT DOCUMENTS

| | | | |
|---|---|---|---|
| 0636509 | 3/1962 | Italy | 339/191 R |

*Primary Examiner*—Gil Weidenfeld
*Assistant Examiner*—Thomas M. Kline
*Attorney, Agent, or Firm*—Nathan D. Herkamp; Philip L. Schlamp; Fred Jacob

[57] ABSTRACT

A female plug body for an electric cord set with at least two contact openings, one opening smaller than the other, has an insert made of a more rigid insulating material than the plug body, disposed within the plug body. The insert has a pair of cavities providing clearance for one side of each of a pair of contacts embedded within the plug body, so that the resistance to insertion of a male plug is not affected by the ambient temperature. The insert also provides a channel providing rigid support for the opening in the plug for the "hot" contact of the female plug which resists insertion of an oversized plug blade into the "hot" contact.

8 Claims, 4 Drawing Figures

PLUG ARRANGEMENT FOR ELECTRIC CORD SET

BACKGROUND OF THE INVENTION

The present invention relates to plug construction for electric cord sets, and, more particularly, to a particular plug construction having a low insertion force at low temperatures and improved resistance to the insertion of an oversized blade into the hot wire side of a female plug.

Among the requirements for electric cord sets is that such equipment not be adversely affected by temperatures at which such devices are normally used. Many cord sets are produced using moldable plastic materials for the plugs. These plastic materials become increasingly rigid as the temperature decreases. As the plugs become rigid it becomes very difficult, if not impossible, to insert a male plug into a female socket. A requirement of standards organizations such as the Underwriter's Laboratories Inc., is that the low temperature insertion force not exceed a predetermined standard. An additional standard required by the Underwriter's Laboratories and other standards agencies, is that the electricity carrying "hot" side, the narrower of the two blade openings of the female plug, be able to resist insertion of an over-sized blade when subjected to a pre-established degree of force. In order to obtain approval of a plug construction, it is necessary that a female plug be capable of passing both standards established by the industry.

SUMMARY OF THE INVENTION

Accordingly, an object of the present invention is to provide a female plug construction capable of meeting both the standard for cold temperature operation and for resisting insertion of an oversized blade. A more specific object of the present invention is to provide an insert into which the contacts for a female plug may be assembled prior to molding of a plug to provide the necessary rigidity against insertion of an oversized blade and yet provide a low insertion force at low temperatures.

Accordingly, the present invention, in a preferred embodiment, includes a rigid plastic insert for supporting the contacts for a female plug which includes air gaps surrounding one side of the contact for each blade of a male plug and a channel arrangement surrounding one contact of the plug to provide adequate resistance to insertion of an oversized blade.

BRIEF DESCRIPTION OF THE DRAWINGS

Further objects and advantages of the present invention together with its organization, method of operation, and best mode contemplated may best be understood by reference to the following description taken in conjunction with the accompanying drawings in which.

DESCRIPTION OF THE PREFERRED EMBODIMENTS

Figure 1:
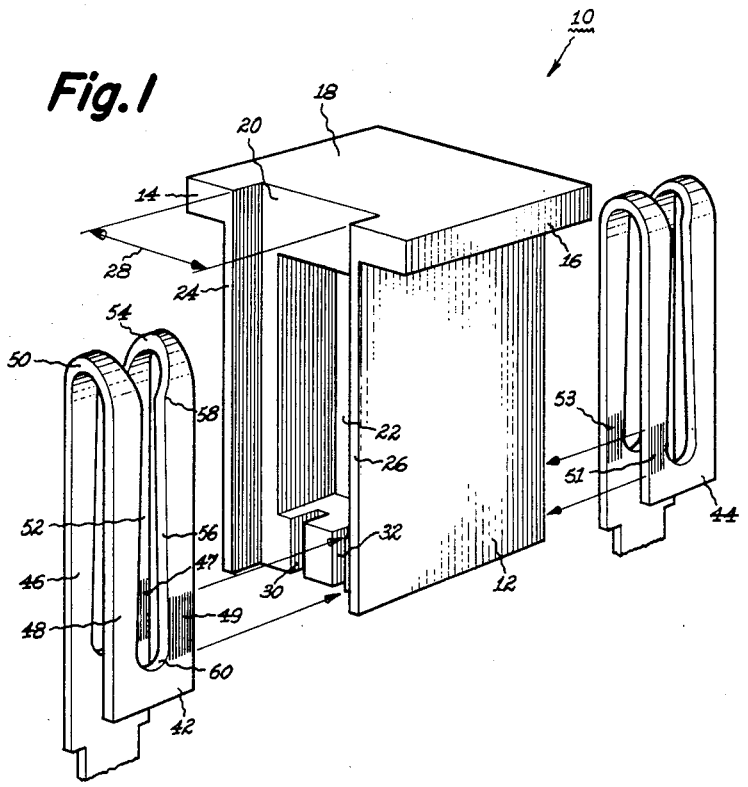
FIG. 1 is a schematic exploded pictorial view of the insert and contacts of the present invention.
Figure 2:
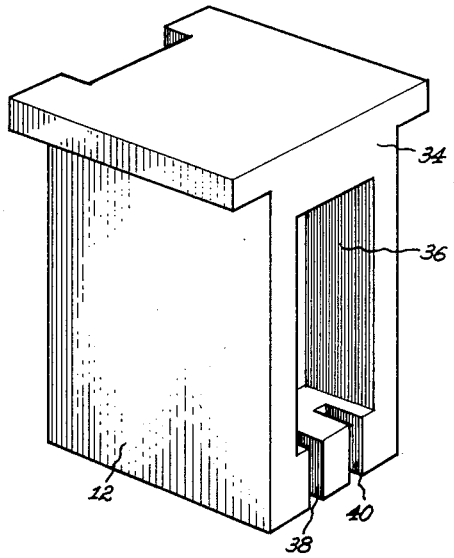
FIG. 2 is a schematic pictorial view of the insert of FIG. 1 showing another side thereof.

As shown in FIG. 1, in one preferred embodiment of the present invention, a rigid plastic insert 10 includes a body 12 of glass-filled nylon material or other suitably rigid plastic material having generally rectangular faces. At the upper end of the body 12, as viewed in FIG. 1, the plastic material is formed into shoulders 14 and 16, creating a larger upper surface 18. In one side face 20 a generally rectangular opening is formed to provide an air gap 22. Extensions of the sides of the body 12 adjacent to surface 20 and of the upper flanges 14 and 16 project beyond surface 20 to provide the generally parallel walls 24 and 26 of a channel 28. Slots 30 and 32 are provided in the face 20 below air gap 22 to provide mounting supports for the electrical contacts. As shown in FIG. 2, the opposite face 34 of the body 12 includes an air gap 36 and slots 38 and 40 to accommodate the other contact of the plug. The generally rectangular parallelepipedal shape of the insert shown in FIGS. 1 and 2 is chosen for convenience of manufacture, and other shapes may be selected to accommodate manufacturing requirements. The generally rectangular parallelepipedal shape of the cavities for air gaps 22 and 36 are also selected for convenience, and other shapes offering no interference with contact movement may be chosen. Each of the respective contacts 42 and 44 comprises a conductive sheet metal member, e.g. of copper or copper alloy, bent into a U-shape to form two side-by-side members 46, 48, joined by a bight 50 and having a portion of the sheet metal removed from both side members 46, 48 of the sheet metal member to form a cutout 52. Each cutout 52 has a sharply tapered portion 54 at the bight area and a slightly tapered portion 56 extending from the point 58 on the member 42 to the end 60 of the cutout 52 so that the cutout has a back-to-back double V shape in each of the sides 46, 48. This cutout shape facilitates the insertion of a male contact blade between the side members 46, 48 and also provides resilience so that the edges of the cutout 52 are biased into engagement with a male contact thereby ensuring firm electrical contact. The contact 44 is made identically with the contact 42 and therefore is not described in detail here. During assembly the areas of the contact 42 shown at 47 and 49 are inserted, respectively, into the slots 30, 32, so that contact 42 is properly positioned for engagement with one of the male contacts of a male plug. The regions 51 and 53 of contact 44 are similarly inserted into slots 38, 40, respectively.

Figure 3:
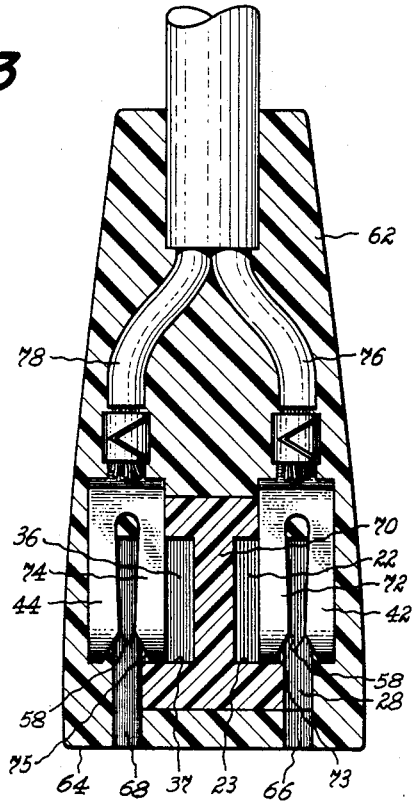
FIG. 3 is a schematic cross-sectional view of a female plug construction including the insert and contact arrangement of the present invention.

After the contacts and insert are assembled as shown, a moldable plastic material, such as polyvinyl chloride, is molded around them to form the female plug as shown in FIG. 3. The moldable plastic material is formed into the plug body 62 with a generally flat end face 64 having generally rectangular openings 66 and 68 extending into said body for insertion of the blade contacts of a male plug. In the final assembly, one side of each of the female contacts is surrounded by a respective one of the air gaps 22 and 36 which are separated by the rib 70 of the insert body 12 and the other side of each of the contacts is embedded within the moldable plastic material of the plug body. The side members 72 and 74 of the respective contacts are supported in cantilever fashion within the air gaps 22 and 36 respectively, and, therefore, their resistance to insertion of the blades of a male plug is affected very little by the temperature surrounding the plug. As shown, the cutouts in the respective sides of the contacts are axially aligned with the respective openings 66, 68 with the hot side aligned with the smaller opening 66 in keeping with the standard in the industry. The projection of the edges of the contacts at the points 58 are shown somewhat exaggerated in FIG. 3 for the purpose of illustration of the bias toward each other. The free ends 73, 75 of side members 72, 74 may contact the ends 23, 37 of respective air gaps 22, 36 as shown in FIG. 3 so long as such contact does not interfere with the free movement of the side members 72, 74 relative to the other parts of the plug. Alternatively, the ends 73, 75 may be spaced from the ends 23, 37. The contacts 42 and 44 are connected with respective ones of the wires 76, 78 within the plug body 62 as shown. The ground contact (not shown) may be the conventional, generally D-shaped contact or other ground contact arrangement. The channel 28 of the insert 10 supports and reinforces the walls of the opening 66, because the material of the insert 10 is more rigid than the material of the plug body 62, so that an oversized plug blade cannot be inserted into the contact 42 without displacing the molded plastic material surrounding the opening for contact 42 and displacing the flanges surrounding the channel 28. To do so would require considerable force, and, therefore, the present invention provides a female plug construction having strong resistance to insertion of an oversized plug blade into the "hot" side of the plug. The present invention also provides a contact arrangement which is nearly unaffected by the temperature surrounding the plug, because only one side of each of the contacts is embedded in the moldable plastic material and the sides 72, 74 readily shift to allow insertion of a male plug blade regardless of temperature.

Figure 4:
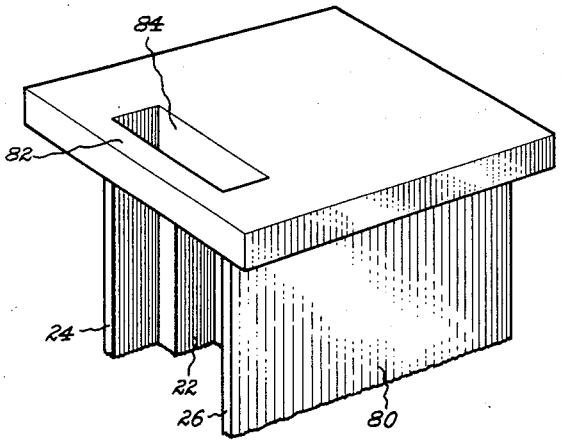
FIG. 4 is a partial schematic pictorial view showing an alternative embodiment of the insert of the present invention.

An alternative embodiment of the insert of the present invention is illustrated schematically in FIG. 4. The insert 80 shown in FIG. 4 has the same features as the insert 10 of FIGS. 1 and 2, except that the upper surface is extended by a projection 82 which extends beyond the edges of walls 24 and 26 to completely surround an opening 84 for the insertion of the "hot" contact. The other elements of the insert 80 are identical with those of the insert 10, are numbered accordingly and will not be described again here. The extension 82 provides additional reinforcement to the channel 28 so that a plug including insert 80 provides additional resistance to the insertion of an oversized male plug blade. The selection of the construction of insert 80 or insert 10 would be dictated by the material from which each was to be made so that adequate resistance to insertion of an oversized blade would be provided. In either of the inserts 10 or 80 the shoulders 14, 16 and other edges of the insert body may be tapered slightly to facilitate their removal from a mold after solidification of the plastic material from which they are made.

The standard test of resistance to insertion of an oversized blade is to apply a male oversized blade to the female opening with 35 pounds of force applied to the blade for a period of one minute. If the female plug material creeps or expands to allow the insertion of the oversized blade into electrical contact, then the female plug fails the test. Both constructions of the inserts illustrated herein have shown adequate resistance to insertion of an oversized blade under the test conditions described above. The test for adequate cold temperature performance requires freezing the plug in a temperature of −10° C. for four hours. The male plug is not required to be given any particular temperature treatment. After freezing the female plug it must be possible to insert a male plug into the female plug with a force of no greater than 30 pounds. The plug construction of the present invention readily meets the requirements of both of the above described tests. The novel plug construction of the present invention provides superior performance at cold temperatures and also provides superior safety from improper insertion of plug blades or other objects into the "hot" contact of the female plug.

What I claim as new and desire to secure by Letters Patent of the United States is:

1. An insert for a female electric plug comprising:

a solid generally parallelepipedal body of electrically insulating material, having first and second pairs of opposed side faces, a top face and a bottom face; first and second concave air gap cavities disposed within respective ones of said first pair of opposed side faces of said body and having a pair of slots in each of said first pair of opposed side faces of said body extending from respective ones of said cavities to said bottom face of said body for supporting electrical contact means in cantilever fashion within said air gap cavities;

extensions from respective ones of said second pair of side faces of said body adjacent one of said first pair of opposed side faces of said body projecting adjacent to the sides of one of said cavities and forming generally parallel walls of an open channel along said one of said first pair of opposed side faces for receiving a male plug blade; and first and second shoulders extending generally perpendicularly from respective ones of said second pair of side faces to form part of said top face whereby said top face has a larger surface area than said bottom face.

2. An insert for a female electric plug comprising:

a generally parallelepipedal body of solid glass filled nylon electrically insulating material, having first and second pairs of opposed side faces, a top face and a bottom face; first and second concave air gap cavities disposed within respective ones of said first pair of opposed side faces of said body and having a pair of slots in each of said first pair of opposed side faces of said body extending from respective ones of said cavities to said bottom face of said body for supporting electrical contact means in cantilever fashion within said air gap cavities;

extensions from respective ones of said second pair of side faces of said body adjacent one of said first pair of opposed side faces of said body projecting adjacent to the sides of one of said cavities and forming generally parallel walls of an open channel along said one of said first pair of opposed side faces for receiving a male plug blade; and first and second shoulders extending generally perpendicularly from respective ones of said second pair of side faces to form part of said top face whereby said top face has a larger surface area than said bottom face.

3. An insert for a female electric plug comprising:

a solid generally parallelepipedal body of electrically insulating material, having first and second pairs of opposed side faces, a top face and a bottom face; first and second concave air gap cavities disposed within respective ones of said first pair of opposed side faces of said body and having a pair of slots in each of said first pair of opposed side faces of said body extending from respective ones of said cavities to said bottom face of said body for supporting electrical contact means in cantilever fashion within said air gap cavities;

extensions from respective ones of said second pair of side faces of said body adjacent one of said first pair of opposed side faces of said body projecting adjacent to the sides of one of said cavities and forming generally parallel walls of an open channel along said one of said first pair of opposed side faces for receiving a male plug blade;

first and second shoulders extending generally perpendicularly from respective ones of said second pair of side faces to form part of said top face whereby said top face has a larger surface area than said bottom face; and a projection of said insulating material extending beyond said walls of said channel at said top face to form an opening for receiving said male plug blade surrounded by said insulating material; said opening being in alignment with said channel.

4. A female electrical plug comprising:

a plug body member for connection to one end of an electrical conductor, said plug body member having a pair of generally rectangular openings in one end thereof extending generally parallel into said plug body member for receiving respective ones of a pair of male plug blades of a male electrical plug;

an insert member of electrically insulating material disposed in said plug body member comprising a generally rectangular parallelepipedal insert body having first and second pairs of opposed side faces and a first concave cavity disposed in one side face of said first pair of side faces of said insert body and a second concave cavity disposed in the opposite side face of said first pair of side faces of said insert body and a pair of contact supporting slots in each face of said first pair of faces; and a pair of electrical contact means each comprising first and second U-shaped conductive members; each U-shaped member having a first side embedded within said plug body member and a second side supported in one of said pairs of slots in cantilever fashion within a respective one of said cavities and aligned with a respective one of said generally rectangular openings such that said first side of said U-shaped member is located on one side and said second side of said U-shaped member is located on the opposite side of said respective one of said openings.

5. The invention of claim 4 wherein each of said contact means comprises:

a sheet member of conductive material folded into a U-shape having a pair of facing side members and having a double V-shaped cutout in each of said side members aligned with a respective one of said openings in said plug body member.

6. The invention of claim 4 wherein said insert member further comprises:

extensions from respective ones of said second pair of side faces of said body adjacent one of said first pair of opposed side faces of said body and projecting adjacent to the sides of one of said cavities and forming generally parallel walls of an open channel along said one of said first pair of opposed side faces; said channel being in alignment with one of said rectangular openings;

first and second shoulders extending generally perpendicularly from respective ones of said second pair of side faces to form part of a top face whereby said top face has a larger surface area than said a bottom face opposite said top face; and a projection of said insulating material extending beyond said walls of said channel at said top face to form an opening surrounded by said insulating material and said opening being in alignment with said channel for receiving one of said male plug blades.

7. A female electrical plug comprising:

a molded polyvinyl chloride plug body member for connection to one end of an electrical conductor, said plug body member having a pair of generally rectangular openings in one end thereof extending generally parallel into said plug body member;

an insert member of electrically insulating material disposed in said plug body member comprising a generally rectangular parallelepipedal insert body of glass-filled electrically insulating material having first and second pairs of opposed side faces having a first concave cavity disposed in one side face of said first pair of side faces of said insert body and a second concave cavity disposed in the opposite side face of said first pair of side faces of said insert body and having a pair of contact supporting slots in each face of said first pair of faces; and a pair of electrical contact means each comprising first and second U-shaped conductive members; each U-shaped member having a first side embedded within said plug body member and a second side supported in one of said pairs of slots in cantilever fashion within a respective one of said cavities and aligned with a respective one of said generally rectangular openings such that said first side of said U-shaped member is located on one side and said second side of said U-shaped member is located on the opposite side of said respective one of said openings.

8. The invention of claim 7 wherein each of said contact means comprises:

a sheet member of conductive material folded into a U-shape having a pair of facing side members and having a double V-shaped cutout in each of said side members aligned with a respective one of said openings in said plug body member.

* * * * *